US008022915B2

(12) United States Patent
Lee et al.

(10) Patent No.: US 8,022,915 B2
(45) Date of Patent: Sep. 20, 2011

(54) LIQUID CRYSTAL DRIVING DEVICE AND DRIVING METHOD THEREOF

(75) Inventors: Dong Hwan Lee, Kyoungki-do (KR); Tae Hyuk Kwon, Kyoungki-do (KR)

(73) Assignee: Hydis Technologies Co., Ltd., Gyeonggi-do (KR)

( * ) Notice: Subject to any disclaimer, the term of this patent is extended or adjusted under 35 U.S.C. 154(b) by 198 days.

(21) Appl. No.: 10/621,250

(22) Filed: Jul. 16, 2003

(65) Prior Publication Data

US 2004/0189573 A1 Sep. 30, 2004

(30) Foreign Application Priority Data

Mar. 25, 2003 (KR) ..... 10-2003-0018397

(51) Int. Cl.
*G09G 3/36* (2006.01)

(52) U.S. Cl. ..... 345/94; 345/100; 345/208; 345/211

(58) Field of Classification Search ..... 345/93, 345/95, 90, 94, 103, 690; 349/149
See application file for complete search history.

(56) References Cited

U.S. PATENT DOCUMENTS

| | | | | |
|---|---|---|---|---|
| 5,155,477 | A * | 10/1992 | Shirochi | 345/87 |
| 5,764,212 | A * | 6/1998 | Nishitani et al. | 345/98 |
| 5,995,074 | A * | 11/1999 | Kusafuka et al. | 345/90 |
| 6,049,319 | A * | 4/2000 | Sakamoto et al. | 345/94 |
| 6,232,944 | B1 * | 5/2001 | Kumagawa et al. | 345/98 |
| 2002/0149318 | A1 * | 10/2002 | Jeon et al. | 315/169.1 |
| 2003/0117356 | A1 * | 6/2003 | Moon et al. | 345/87 |

* cited by examiner

*Primary Examiner* — Seokyun Moon

(57) ABSTRACT

Disclosed is a liquid crystal driving device, which is without a gate PCB, having improved uniformity of screen, and a driving method thereof. The liquid crystal driving device comprises: a sequence recognition means for recognizing sequence of a pertinent gate driver IC by a pulse width of a vertical start signal inputted in synchronization with a vertical synchronous signal, and generating a Carry signal and location data of the pertinent gate driver IC; and a gate-off voltage generation means for receiving a first gate-off voltage and the location data of the pertinent gate driver IC, and outputting a second gate-off voltage which is generated by subtracting a voltage attenuation quantity corresponding to the location data of the gate driver IC from the first gate-off voltage.

14 Claims, 11 Drawing Sheets

| GDN | REF |
|---|---|
| 0 | REF 0 |
| 1 | REF 1 |
| 2 | REF 2 |
| 3 | REF 3 |
| n-1 | REF n-1 |

LIQUID CRYSTAL DRIVING DEVICE AND DRIVING METHOD THEREOF

BACKGROUND OF THE INVENTION

1. Field of the Invention

The present invention relates to a liquid crystal driving device and a driving method thereof, and more particularly to a liquid crystal driving device driving liquid crystal so that an image is displayed uniformly throughout all of a liquid crystal screen, and a driving method thereof.

2. Description of the Prior Art

Recently, TFT-LCD (Thin Film Transistor Liquid Crystal Display) technology has been developed to secure a lower price, a lighter weight, a lower power, and higher reliability. Therefore, a line-on-glass type (hereinafter, referred to "LOG-type") of liquid crystal display device has been developed and produced, the LOG-type liquid crystal display device having a lower substrate on which signal line patterns are formed so as to provide a pertinent drive signal and a pertinent data signal to each of a plurality of gate driver ICs (Integrated Circuits) and a plurality of source driver ICs, without a gate Printed Circuit Board (hereinafter, the Printed Circuit Board is referred to "PCB") and a Flexible Printed Circuit board (hereinafter, referred to "FPC")

FIG. 1 is a view illustrating a LOG-type liquid crystal display device without a gate PCB in accordance with the prior art. As shown in FIG. 1, the LOG-type liquid crystal display device includes: a liquid crystal panel 10 formed by combining an upper substrate 10*a* and a lower substrate 10*b*, with liquid crystal interposed between the substrates 10*a* and 10*b*; a source PCB 12; a plurality of source driver ICs 16, each of which is packaged in a TCP (Tape Carrier Package) 14, electrically connecting the source PCB 12 with one side portion of the lower substrate 10*b*; a plurality of gate driver ICs 20 packaged in TCPs by ones and electrically connected to another side portion of the lower substrate 10*b*; and signal line patterns 22 formed along bonding portion of the TCPs 18 and the gate driver ICs 20 so as to provide a power, a drive signal, and control signals for driving the gate driver ICs 20.

The liquid crystal panel 10 includes: a plurality of data lines DLs arranged in a column direction; a plurality of gate lines GLs arranged in a row direction; a plurality of thin-film transistors STs arranged with a matrix pattern in regions of intersection of the data lines DLs and the gate lines GLs; and liquid crystal capacities $C_{LC}$ formed between each of the thin-film transistors STs and a common electrode. Also, the liquid crystal panel 10 is constructed in such a manner that gate-on/off signals provided through the source driver PCB 12 so as to drive the gates of the thin-film transistors STs are applied to the gate lines GLs in sequence through the signal line patterns 22, and a data signal applied through the source driver ICs 16 is applied to the data lines DLs. The TCP may be replaced by a COF (Chip on Film).

FIG. 2 is a detailed view of the signal line patterns 22 shown in FIG. 1, in which the same reference numerals are used to designate the same or similar components. In FIG. 2, a reference numeral 24 designates a plurality of output channels for transmitting a drive signal, which is outputted from the gate driver ICs 20, to the liquid crystal panel 10.

In the conventional liquid crystal display device having such a construction, the signal line patterns 22 include a resistance component, and the values of the resistance component R1 and R2 are determined in accordance with material, thickness, and width of used metal. For example, in the case of an amorphous silicon thin-film transistor LCD (a-Si TFT LCD), a resistance value of the signal line patterns 22 ranges from few ohms to hundreds of ohms. In particular, when the signal line patterns are formed on the liquid crystal panel 10, the resistance value is increased because the pattern formation is small. Therefore, whenever a gate drive signal for switching on/off the gate of the thin film transistor ST (see FIG. 1) passes each of the gate driver ICs 20, a garadual voltage drop necessarily occurs.

FIG. 3 is a waveform view showing gate drive signals of gate driver ICs in accordance with the prior art. In FIG. 3, a reference character "GD1" designates a first gate drive signal of a first gate driver IC, a reference character "GD2" designates a second gate drive signal of a second gate driver IC, and a reference character "GD3" designates a third gate drive signal of a third gate driver IC.

As shown in FIG. 3, a level of a gate-off voltage $V_{GO1}$ of the first gate driver IC is changed by flowing current and resistance of the signal line patterns 22, while the level of a gate-off voltage is more and more increased according to approach to the gate driver IC of the final end. To be more specific, a level of a second gate-off voltage $V_{GO2}$ of the second gate driver IC rises to a higher level as compared to the level of the first gate-off voltage $V_{GO1}$ of the first gate driver IC, and a level of a third gate-off voltage $V_{GO3}$ of the third gate driver IC rises to a higher level as compared to the level of the second gate-off voltage $V_{GO2}$ of the second gate driver IC.

Meanwhile, like the case of the signal line patterns 22 for applying a gate drive signal, delay of data voltage signal is caused also in other signal line patterns (not shown), which is formed on one side portion of the lower substrate 10*b* of the liquid crystal panel 10 so as to apply a data signal to the data lines DLs, due to impedances of the signal lines itself and data lines DLs.

Such voltage drop and signal delay caused by the signal line patterns decrease amplitude of a gate drive signal, and causes variance in charge quantity and leakage quantity of data voltage according to an on/off characteristic curve of the TFT (Thin-Film Transistor). Such a phenomenon becomes more and more severe due to increase in length of the signal lines, which is caused according to development tendencies of liquid crystal display devices towards high resolution, large scale, and decrease of charging time (one horizontal period) due to increase of frame frequency. As a result, it cause a screen quality problem, such as a block phenomenon showing that blocks of gate driver ICs display different brightness from each other, variation of uniformity and flicker between an upper end and a lower end of a screen, and degradation of response speed.

A variety of methods may be used to solve the problem described above. One method of them is to compensate the rise of the gate-off level by extending the width of the signal line patterns 22 so that resistance value lessens. However, it is difficult to apply this method to practical use because of constraint condition on design. That is, it is because the area for forming the signal line patterns 22 in the lower substrate of the liquid crystal display device is limited, also because the width of the signal line patterns 22 formed on a bonding portion of the gate driver ICs 20 is narrow.

Another method is to sufficiently secure area for forming the signal line patterns 22 in the lower substrate by extending size of the liquid crystal panel. However, this is not matched with recent request for a low price and a light weight, and also causes another problem in that it is difficult to correspond to an international standard in size of goods.

Still another method is to coincide a resistance value of an inside signal line patterns existed in the gate driver ICs 20 with that of the signal line patterns of the panel so that non-uniformity of a screen caused at boundary faces among the gate driver ICs 20 is reduced. However, this method has an economic problem in that design of the gate driver ICs 20 must be changed every time according to several variables, such as size and resolution of a liquid crystal panel, etc.

FIG. 4 is a view showing data waveforms and charging curves of pixels of each gate line in a liquid crystal display device according to the prior art. In FIG. 4, a reference numeral 1 designates a gate voltage waveform applied to an upper end of gate lines, a reference numeral 2 designates a data voltage waveform applied to the upper end of gate lines, and a reference numeral 3 designates a charge voltage of a pixel in the upper end of gate lines. Also, a reference numeral 1' designates a gate voltage waveform applied to a lower end of gate lines, a reference numeral 2' designates a data voltage waveform applied to the lower end of gate lines, and a reference numeral 3' designates a charge voltage of a pixel in the lower end of gate lines.

As shown in FIG. 4, gate-on voltage decrease of $\Delta V_{Gon}$ causes decrease of gate-on current, gate-off voltage decrease of $\Delta V_{Goff}$ causes increase of leakage current, and charging quantity as much as $\Delta V_c$ is decreased.

FIG. 5 is a view showing a characteristic curve of data currents according to gate voltages in a liquid crystal display device in accordance with the prior art. In FIG. 5, a reference character 'a' designates a current characteristic region when the gate-on voltage is applied, and a reference character 'b' designates a leakage current characteristic region when the gate-off voltage is applied.

FIG. 6 is a view showing charge voltages of data according to gate lines in a liquid crystal display device in accordance with the prior art. Herein, X-axis designates gate lines and Y-axis designates charge voltages. Also, in FIG. 6, a reference character 'd' designates a desired charge voltage level, a reference character 'e' designates real charge voltage levels, and a reference character 'f' designates a region in which a block phenomenon is caused.

As shown in FIG. 6, in each of the gate lines driven by a plurality of gate drivers (Driver0, Driver1, Driver2), decrease of charge voltage in accordance with signal delay of the data lines is caused.

SUMMARY OF THE INVENTION

Accordingly, the present invention has been made to solve the above-mentioned problems occurring in the prior art, and a first object of the present invention is to provide a liquid crystal driving device, which is without a gate PCB, capable of improving uniformity of image quality by controlling that the same gate-off voltage is generated at every gate driver ICs, in such a manner of subtracting a voltage attenuation quantity predetermined corresponding to sequence of each gate driver IC from the gate-off voltage inputted to signal line patterns.

To solve the above-mentioned problems, a second object of the present invention is to provide a liquid crystal driving device, which is without a gate PCB, capable of improving uniformity of image quality by compensating signal level attenuation of data, in such a manner of boosting signal level of the input data according to the number of gate driver ICs and the number of gate lines, and a driving method thereof.

In order to accomplish the first object, there is provided a liquid crystal driving device generating gate-on/off signals to drive liquid crystal, the liquid crystal driving device comprising: a sequence recognition means for recognizing sequence of a pertinent gate driver IC by a pulse width of a vertical start signal inputted in synchronization with a vertical synchronous signal, and generating a Carry signal and location data of the pertinent gate driver IC; and a gate-off voltage generation means for receiving a first gate-off voltage and the location data of the pertinent gate driver IC, and outputting a second gate-off voltage which is generated by subtracting a voltage attenuation quantity corresponding to the location data of the gate driver IC from the first gate-off voltage.

In order to accomplish the second object, there is provided a liquid crystal driving device comprising: a liquid crystal panel including a plurality of signal line patterns to apply a data signal; a look-up table for storing a plurality of reference data corresponding to the number of gate driver ICs; a reference data generation section for selecting and outputting one of the plurality of reference data; a boosting section for boosting signal level of input data by adding the selected reference data to the input data, and outputting the boosted input data to the plurality of signal line patterns; a count section for generating a count value by counting the number of transitional edges of a vertical synchronous signal; and a control section for calculating a plurality of parameter values on the basis of the number of gate driver ICs and the number of gate lines, comparing the count value counted by the count section with the calculated parameter values, and controlling the reference data generation section to select and output one of the plurality of reference data with reference to the look-up table according to a result of the comparison.

In order to accomplish the second object, there is provided a liquid crystal driving method comprising the steps of: generating a count value by counting gate clock signals; calculating a plurality of parameter values on the basis of the number of gate driver ICs and the number of gate lines; comparing the count value with the parameter values; selecting one of a plurality of reference data, corresponding to the number of gate driver ICs with reference to a look-up table according to a result of the comparison step; boosting signal level of input data by adding the input data to the selected reference data; and outputting the boosted data to a signal line pattern for applying data signal.

In order to accomplish the first and second objects, there is provided a liquid crystal driving device comprising: a sequence recognition means for recognizing sequence of a pertinent gate driver IC by a pulse width of a vertical start signal inputted in synchronization with a vertical synchronous signal, and generating a Carry signal and location data of the pertinent gate driver IC; a gate-off voltage generation means for receiving a first gate-off voltage and the location data of the pertinent gate driver IC, and outputting a second gate-off voltage which is generated by subtracting a voltage attenuation quantity corresponding to the location data of the gate driver IC from the first gate-off voltage; a liquid crystal panel including a plurality of signal line patterns to apply a data signal; a look-up table for storing a plurality of reference data corresponding to the number of gate driver ICs; a reference data generation section for selecting and outputting one of the plurality of reference data; a boosting section for boosting signal level of input data by adding the selected reference data to the input data, and outputting the boosted input data to the plurality of signal line patterns; a count section for generating a count value by counting the number of transitional edges of a vertical synchronous signal; and a control section for calculating a plurality of parameter values on the basis of the number of gate driver ICs and the number of gate lines, comparing the count value counted by the count section with the calculated parameter values, and controlling the reference data generation section to select and output one of the plurality of reference data with reference to the look-up table according to a result of the comparison.

BRIEF DESCRIPTION OF THE DRAWINGS

The above and other objects, features and advantages of the present invention will be more apparent from the following detailed description taken in conjunction with the accompanying drawings, in which:

As shown in FIG. 13, the liquid crystal driving device comprises a liquid crystal panel 100, a look-up table 200, a reference data generation section 300, a boasting section 400, a count section 600, and a control section 500.

DETAILED DESCRIPTION OF THE PREFERRED EMBODIMENTS

Figure 1:
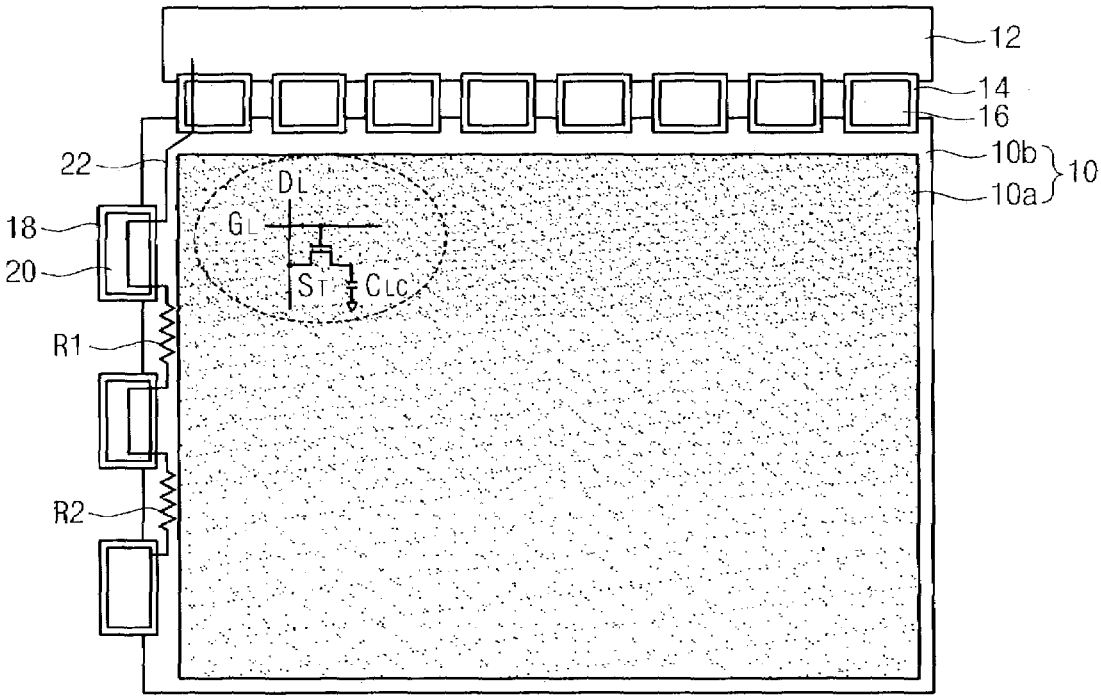
FIG. 1 (PRIOR ART)
FIG. 1 is a view illustrating a liquid crystal display device without a gate PCB in accordance with the prior art.
Figure 2:
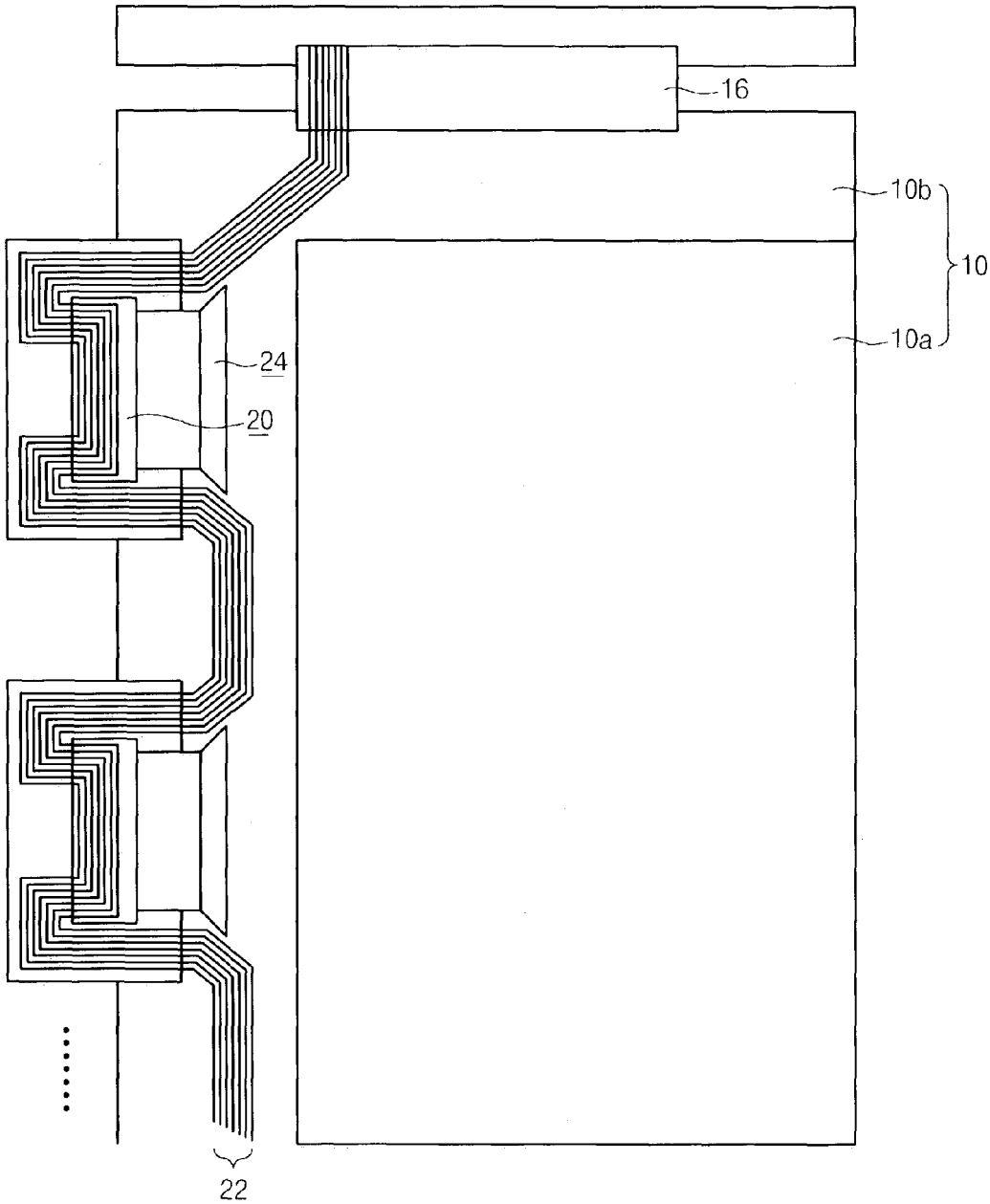
FIG.2 (PRIOR ART)
FIG. 2 is a detailed view of the signal line patterns of FIG. 1.
Figure 3:
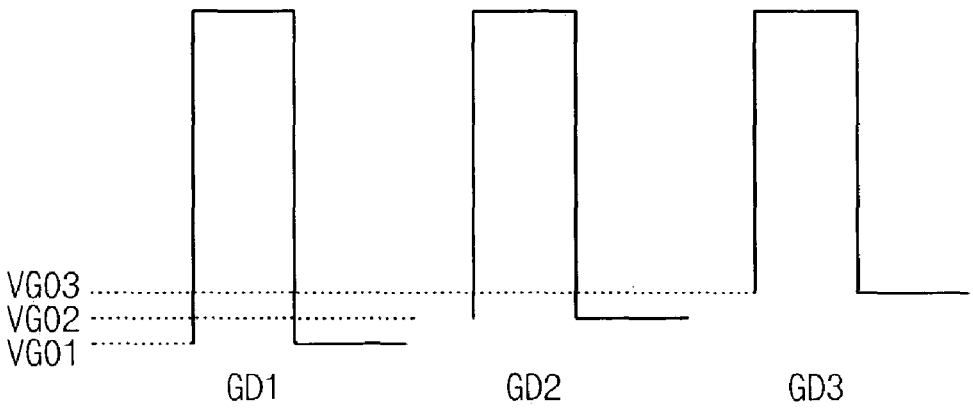
FIG.3 (PRIOR ART)
FIG. 3 is a waveform view showing output waveforms of gate driver ICs in accordance with the prior art.
Figure 4:
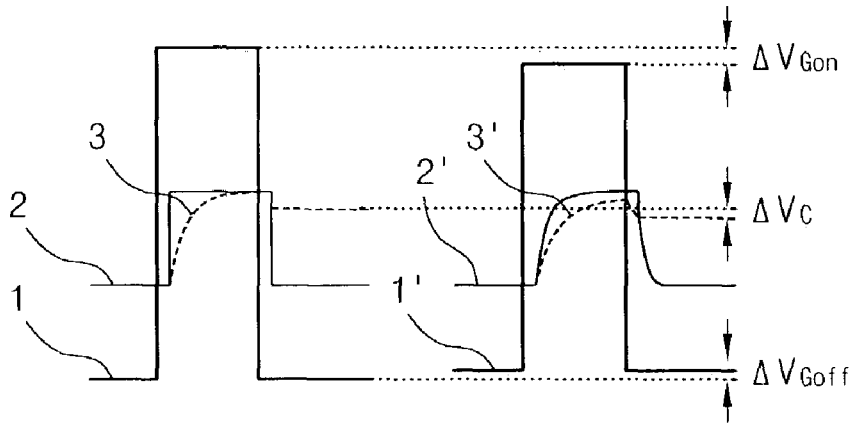
FIG.4 (PRIOR ART)
FIG. 4 is a view showing data waveforms and charging curves according to gate lines in a liquid crystal display device in accordance with the prior art.
Figure 5:
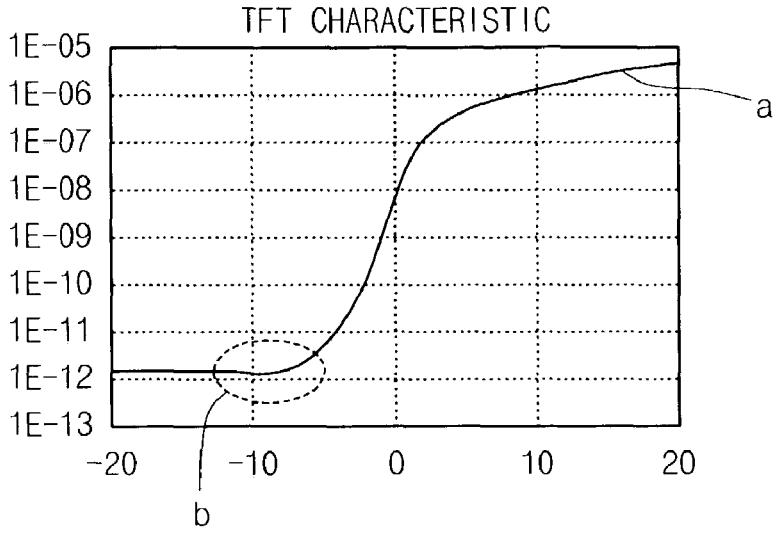
FIG.5 (PRIOR ART)
FIG. 5 is a view showing a characteristic curve of data currents according to gate voltages in a liquid crystal display device in accordance with the prior art.
Figure 6:
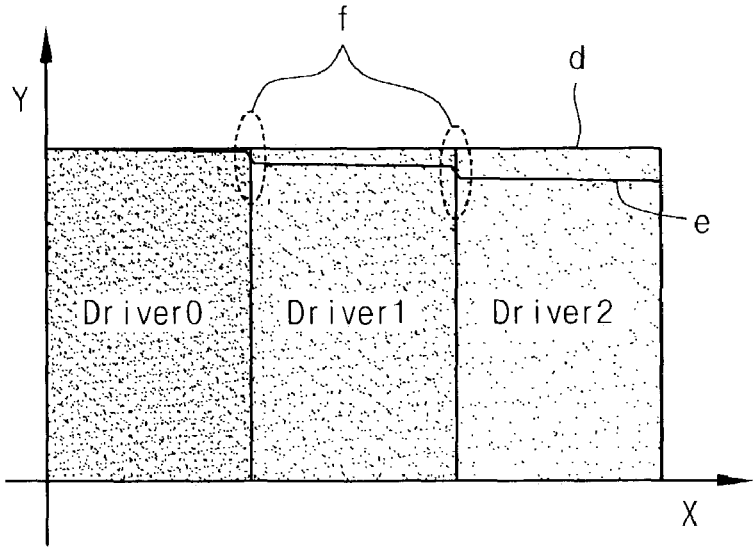
FIG.6 (PRIOR ART)
FIG. 6 is a view showing charge voltages of data according to gate lines in a liquid crystal display device in accordance with the prior art.

Hereinafter, a preferred embodiment of the present invention will be described with reference to the accompanying drawings. In the following description and drawings, the same reference numerals are used to designate the same or similar components, and so repetition of the description on the same or similar components will be omitted.

Figure 7:
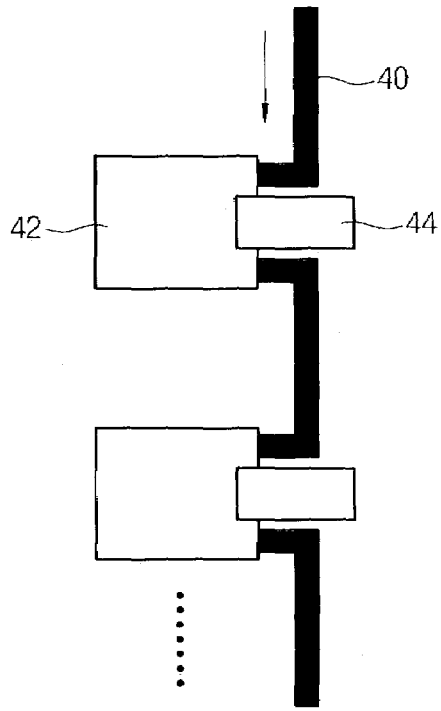
FIG. 7 is a view for explaining a principle to calculate gate-off voltages according to an embodiment of the present invention.

FIG. 7 is a view for explaining a principle to calculate gate-off voltages according to an embodiment of the present invention. In FIG. 7, a reference numeral 40 designates signal line patterns, a reference numeral 42 designates a TCP, and a reference numeral 44 a gate driver IC. Herein, the TCP may be replaced by a COF (Chip on Film).

As shown in FIG. 7, a gate-off voltage $V_{GI}$ is applied to the beginning end of the signal line patterns 40, so that a current Ig flows towards the final end of the signal line patterns 40. Herein, when the overall resistance is defined as 'Rp', the voltage Vs of the signal line patterns 40 is represented as 'Ig×Rp'.

In an embodiment of the present invention, it is performed to subtract a voltage attenuation quantity predetermined corresponding to sequence of each gate driver IC from the gate-off voltage $V_{GI}$ inputted to the signal line patterns 40 so that each gate driver IC 44 generates the same gate-off voltage $V_{GO}$, in which the predetermined voltage attenuation quantity is calculated by multiplying a voltage $V_s$ of the signal line patterns 40 by the number of gate driver ICs corresponding to location of a gate driver IC.

For example, in a case of a liquid crystal display device using N number of gate driver ICs, a first gate driver IC generates a gate-off voltage $V_{GO1}$ which is obtained by subtracting a first value from an inputted gate-off voltage $V_{VGI}$, in which the first value is obtained by multiplying a voltage $V_s$ of the signal line patterns 40 by 'N', the number of gate driver ICs.

A second gate driver IC generates a gate-off voltage $V_{GO2}$ which is obtained by subtracting a second value from an inputted gate-off voltage $V_{GI}$, in which the second value is obtained by multiplying a voltage $V_s$ of the signal line patterns 40 by 'N−1', the number of gate driver ICs.

Through a repetition of the processes described above, a $N^{th}$ gate driver IC generates a gate-off voltage $V_{GON}$ which is obtained by subtracting a $N^{th}$ value from an inputted gate-off voltage $V_{GI}$, in which the $N^{th}$ value is obtained by multiplying a voltage $V_s$ of the signal line patterns 40 by '1', the number of gate driver IC.

The example described above is represented as following equation 1.

$$V_{GO1}=V_{GI}-(V_s\times N) \qquad \text{Equation 1}$$

$$V_{GO2}=V_{GI}-(V_s\times(N-1))$$

$$V_{GON}=V_{GI}-(V_S\times 1)$$

Figure 8:
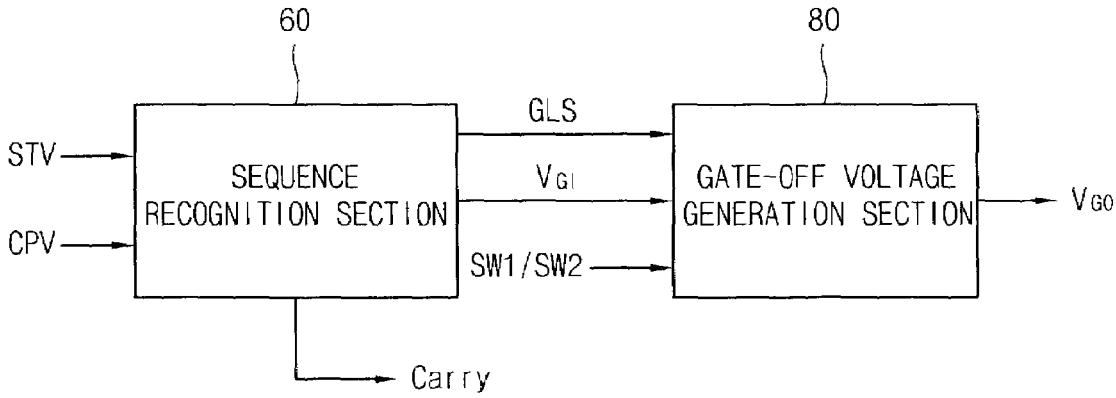
FIG. 8 is a block diagram showing a liquid crystal driving device according to an embodiment of the present invention.

FIG. 8 is a block diagram showing a liquid crystal driving device according to an embodiment of the present invention. As shown in FIG. 8, a liquid crystal driving device comprises a sequence recognition section 60 and a gate-off voltage generation section 80. The sequence recognition section 60 recognizes location of a pertinent gate driver IC by a pulse width of a vertical start signal STV inputted in synchronization with a vertical synchronous signal CPV, and generates a Carry signal and location data GLS of the pertinent gate driver IC. The gate-off voltage generation section 80 receives a first gate-off voltage $V_{GI}$ and the location data GLS of the pertinent gate driver IC, and outputs a second gate-off voltage $V_{GO}$ which is generated by subtracting a voltage attenuation quantity corresponding to the location data GLS of the pertinent gate driver IC from the first gate-off voltage $V_{GI}$.

Figure 9:
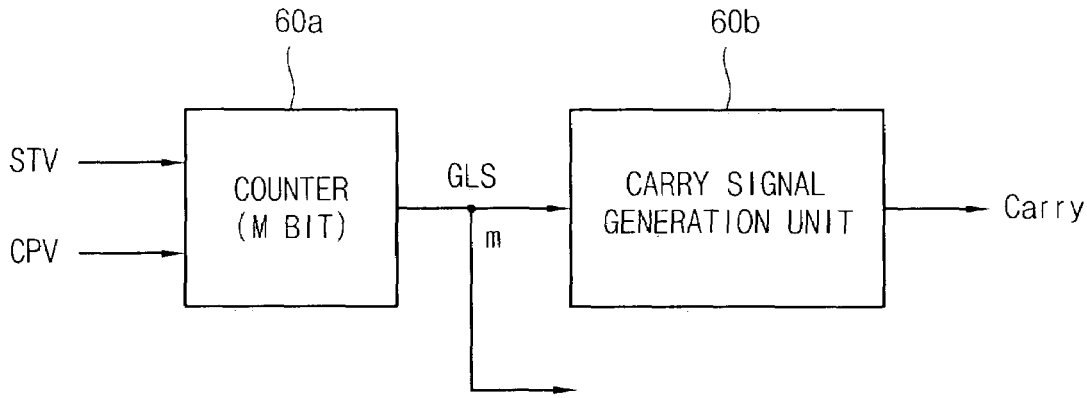
FIG. 9 is a block diagram showing a sequence recognition section of a gate driver IC according to an embodiment of the present invention.

FIG. 9 is a block diagram showing a sequence recognition section 60 of a gate driver IC according to an embodiment of the present invention. The sequence recognition section 60 comprises an m-bit counter 60*a* and a carry signal generation unit 60*b*. The m-bit counter 60*a* estimates a pulse width of the vertical start signal inputted in synchronization with the vertical synchronous signal, and generates location data of the pertinent gate driver IC. The carry signal generation unit 60*b* generates a Carry signal that a vertical start signal STV thereof has a pulse width changed on the basis of a value of location data GLS of the pertinent gate driver IC.

Figure 10:
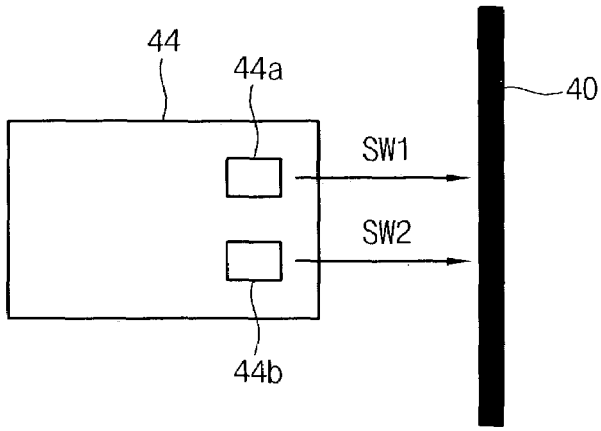
FIG. 10 is a view showing a connection state between a gate driver IC and signal line patterns according to an embodiment of the present invention.

FIG. 10 is a view showing a connection state between a gate driver IC and signal line patterns according to an embodiment of the present invention. As shown in FIG. 10, switch pins 44*a* and 44*b* included in a gate driver IC 44 connects to a ground or a logic power line in signal line patterns 40.

It is preferred that each location of the switch pins 44*a* and 44*b* is set at positions capable of connecting easily to a ground or a logic power line.

Resistance Rp of the signal line patterns 40 and gate-off current Ig may differ according to resolution, size of its liquid crystal panel, characteristics (material, thickness and width) of its signal line patterns, and so forth in a liquid crystal display device. Therefore, it is preferred to predetermine several states in advance in consideration of resistance Rp of signal line patterns 40 and gate-off current Ig which can be easily made in general processes. To this end, the number of switch pins may be properly changed.

For example, in the case of using two number of switch pins 44*a* and 44*b*, combination of signals SW1 and SW2 outputted from the switch pins 44*a* and 44*b* is classified into four states, that is, a first state represented as a logic level '00', a second state represented as a logic level '01', a third state represented as a logic level '10', and a fourth state represented as a logic level '11'. Signals of the first to fourth states is provided to the gate-off voltage generation section 80 so as to generate a compensation value according to resolution, size of its liquid crystal panel, characteristics (material, thickness and width) of its signal line patterns, and so forth in a liquid crystal display device.

Therefore, in an embodiment of the present invention, it is performed to subtract a voltage attenuation quantity predetermined corresponding to sequence of each gate driver IC from the gate-off voltage $V_{GI}$ inputted according to predetermined states, so that each gate driver IC 44 can generate the same gate-off voltage.

Figure 11:
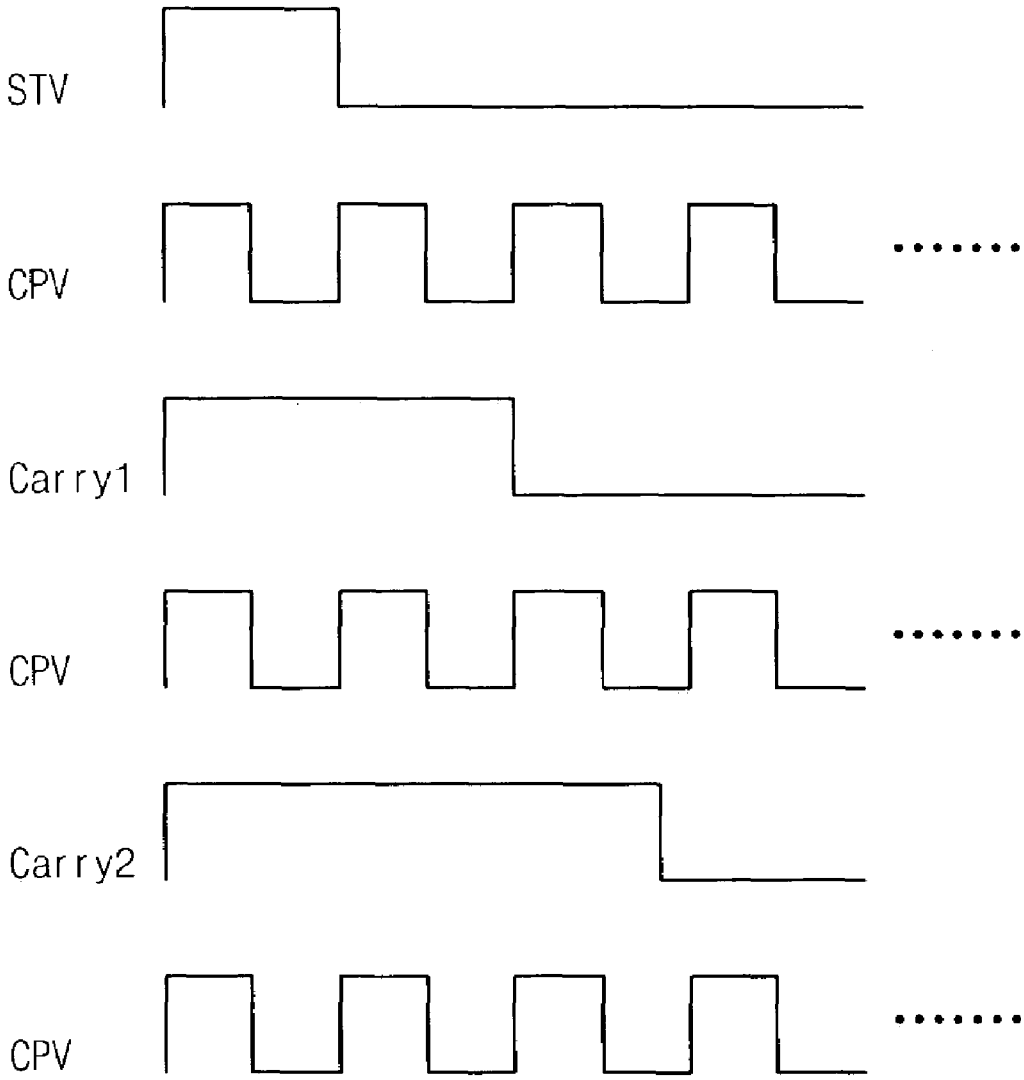
FIG. 11 is a waveform view showing Carry signals of gate driver ICs according to an embodiment of the present invention.

FIG. 11 is a waveform view showing sequence recognition signals of gate driver ICs according to an embodiment of the present invention. In FIG. 11, a reference character 'Carry1', which is a vertical start signal, designates a first Carry signal outputted from a first gate driver IC to a second gate driver IC, and a reference character 'Carry2', which is a vertical start signal, designates a second Carry signal outputted from a second gate driver IC to a third gate driver IC.

Operation of a liquid crystal driving device having the construction as described above according to an embodiment of the present invention will be described with reference to FIG. 11.

First, the m-bit counter 60*a* in the sequence recognition section 60 estimates a pulse width of the vertical start signal STV inputted to a first gate driver IC in synchronization with the vertical synchronous signal CPV, recognizes location of a pertinent gate driver IC on the basis of the counted value, and generates m-bit location data GLS corresponding to the sequence of the pertinent gate driver IC.

Subsequently, the carry signal generation unit 60*b* in the sequence recognition section 60 processes a pulse width of the vertical state signal STV on the basis of location data GLS provided from the m-bit counter 60*a*, as shown in FIG. 11, and generates a first Carry signal (Carry1) having wider width than that of a vertical start signal STV inputted to the first gate driver IC. The first Carry signal (Carry1) is used as a vertical start signal for the next gate driver IC.

Next, the gate-off voltage generation section 80 receives location data GLS from the sequence recognition section 60, and receives a gate-off voltage $V_{GI}$ through the signal line patterns 40.

Subsequently, the gate-off voltage generation section 80 subtracts a voltage attenuation quantity corresponding to the location data GLS of the gate driver IC from the gate-off voltage $V_{GI}$, and generates the gate-off voltage $V_{GO}$ to drive liquid crystal.

When such operation is successively performed to all gate driver ICs used in a liquid crystal display device, each gate driver IC can generate the same level of gate-off voltage $V_{GO}$.

Meanwhile, in an embodiment of the present invention, it is performed to compensate for variation of each gate-off voltage $V_{GO}$ caused in each gate driver IC according to resolution, size of its liquid crystal panel, characteristics (material, thickness and width) of its signal line patterns, and so forth in a liquid crystal display device, in using the first state to the fourth state signals which are combinations of signals SW1 and SW2 outputted from the switch pins 44*a* and 44*b*, so that each of the gate driver ICs outputs the same level of gate-off voltage $V_{GO}$.

In the case of using the first state to the fourth state signals, the operation of the gate-off voltage generation section 80 is as follows. First, the gate-off voltage generation section 80 receives location data GLS from the sequence recognition section 60, receives a gate-off voltage $V_{GI}$ through the signal line patterns 40, and receives signals SW1 and SW2 outputted from the switch pins 44*a* and 44*b*.

Next, the gate-off voltage generation section 80 subtracts a voltage attenuation quantity corresponding to the location data GLS of the gate driver IC from the gate-off voltage $V_{GI}$, and adds a compensation voltage value corresponding to the first state to the fourth state signals to the subtracted gate-off voltage, thereby generating a compensated gate-off voltage $V_{GO}$ to drive the liquid crystal.

When such an operation is successively performed to all gate driver ICs used in a liquid crystal display device, it is possible to compensate for a variation of each gate-off voltage $V_{GO}$ caused in each gate driver IC according to resolution, size of its liquid crystal panel, characteristics (material, thickness and width) of its signal line patterns, and so forth in a liquid crystal display device, in addition, each gate driver IC can generate the same level of gate-off voltage $V_{GO}$.

Figure 12:
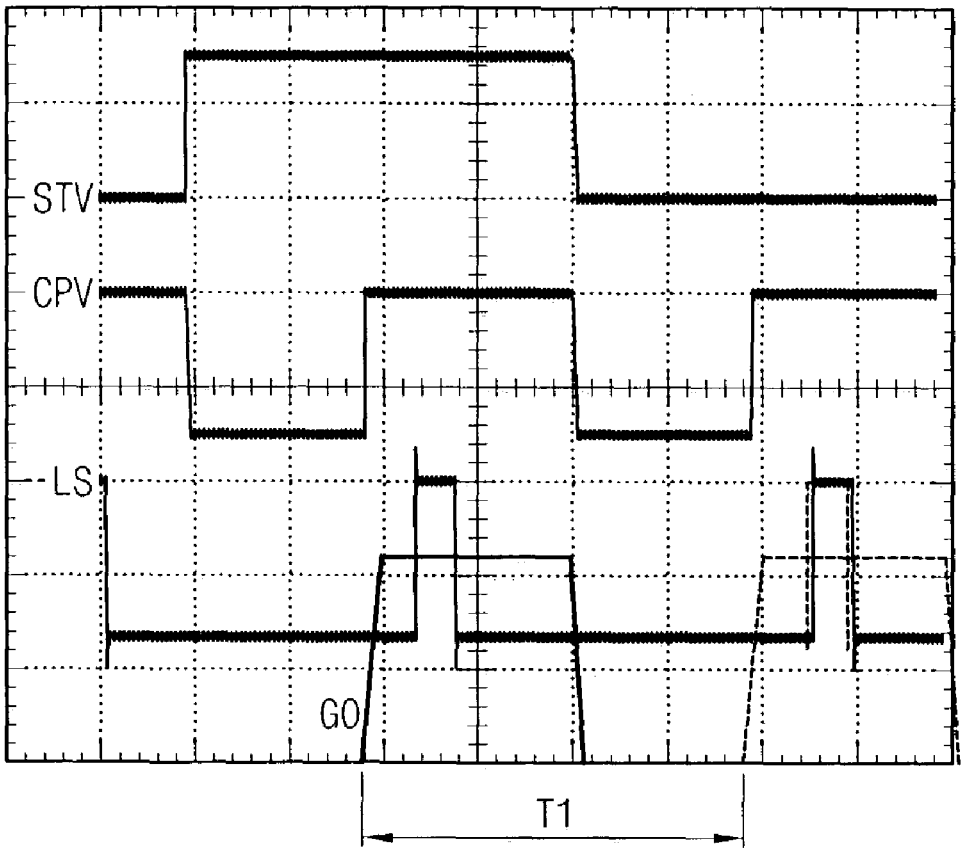
FIG. 12 is a timing chart showing output signals of gate driver ICs according to an embodiment of the present invention.

FIG. 12 is a timing chart showing output signals of gate driver ICs according to an embodiment of the present invention. In FIG. 12, a reference character 'STV' designates a vertical start signal, a reference character 'CPV' designates a vertical synchronous signal, a reference character 'LS' designates data load signals, and a reference character 'GO' designates output signals of gate driver ICs, that is, gate-off signals.

In the data load signals LS of FIG. 12, one signal illustrated as a solid line designates an data load signal according to the prior art, and the other signal illustrated as a dotted line designates an data load signal according to an embodiment of the present invention.

Meanwhile, in the output signals GO of gate driver ICs of FIG. 12, one signal illustrated as a solid line designates, an output signal of a conventional gate driver IC, and the other signal illustrated as a dotted line designates an output signal of a gate driver IC according to an embodiment of the present invention.

In accordance with an embodiment of the present invention, since a gate driver IC receives a vertical start signal having a pulse width and recognizes its sequence by the pulse width, it is required to control a point of time at which output data of a source driver IC is applied to the liquid crystal panel.

Therefore, in an embodiment of the present invention, it is proposed to control a point of time at which a load signal LS—a signal for applying output data of a source driver IC to the liquid crystal panel—is applied, and a point of time at which an output signal of the gate drive IC is applied to the liquid crystal panel. That is, as shown in FIG. 12, a data load signal LS and an output signal GO of the gate driver IC according to the present invention are generated later, by a predetermined time T, than are such signals according to the prior art.

Figures 13, 14:
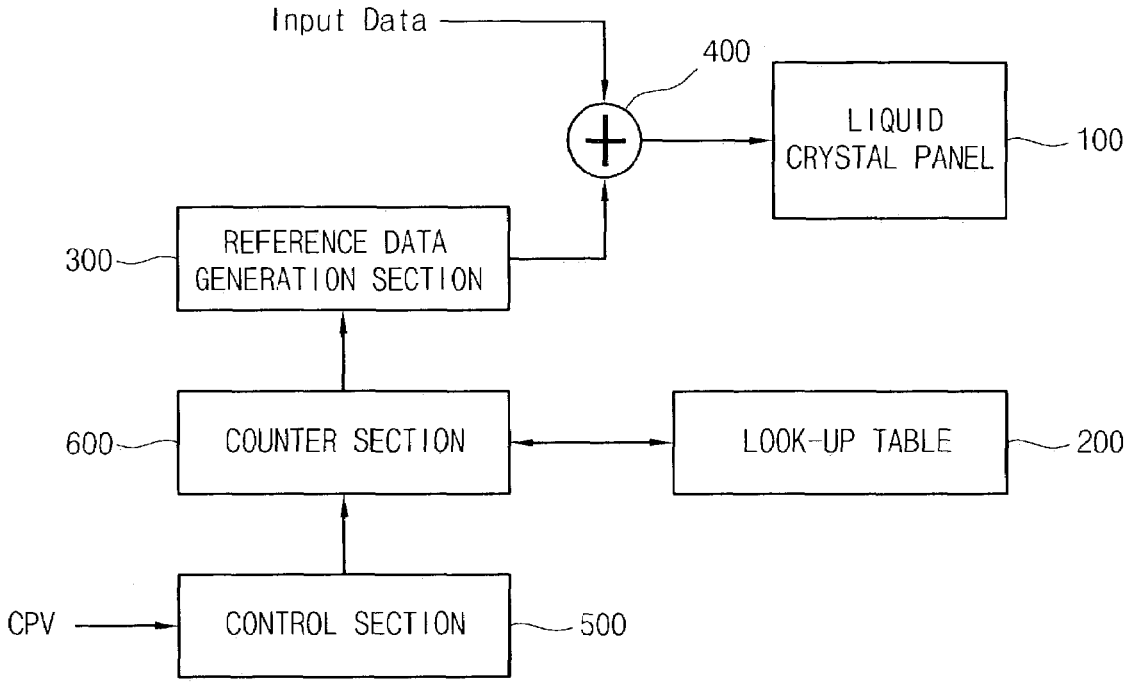
FIG. 13 is a view showing a liquid crystal driving device according to the other embodiment of the present invention.
FIG. 14 is a view showing a look-up table according to the other embodiment of the present invention.

FIG. 13 is a view showing a liquid crystal driving device according to the other embodiment of the present invention. As shown in FIG. 13, the liquid crystal driving device comprises a liquid crystal panel 100, a look-up table 200, a reference data generation section 300, a boosting section 400, a count section 600, and a control section 500.

The liquid crystal panel 100, as generally known in the art, includes a plurality of first signal line patterns (not shown) formed along one side portion of a lower substrate so as to apply a data signal to a plurality of data lines (not shown), and a plurality of second signal line patterns (not shown) formed along another side portion of the lower substrate so as to apply a drive signal to a plurality of gate lines (not shown).

In the look-up table 200, a plurality of reference data corresponding to the number of gate driver ICs are stored in advance. The reference data generation section 300 is constructed to select and output one of a plurality of reference data. The boosting section 400 is constructed to receive input data and reference data selected by the reference data generation section 300, to boost signal level of the input data by adding the selected reference data to the input data, and to output the boosted input data to the first signal line patterns (not shown). The count section 500 includes a binary counter to receive a vertical synchronous signal CPV and to generate a count value CNT by counting the transition number of a leading edge or a tailing edge of the vertical synchronous signal CPV. The control section 600 calculates a plurality of parameter values P1 to Pn from the number of gate lines GLN on the basis of the number of gate drivers GDN, comparers the count value CNT counted by the count section 500 with the calculated parameter values P1 to Pn, and controls the reference data generation section 300 so as to select and output one of a plurality of reference data pre-stored in the look-up table 200 according to a result of the comparison.

According to the embodiment of the present invention, the parameter values P1 to Pn are determined as values obtained by assigning different weight values to each division value (GLN/GDN) obtained by dividing the number GLN of gate lines by the number GDN of gate drivers. For example, a first parameter value P1 is '1×(GLN/GDN)', a second parameter value P2 is '2×(GLN/GDN)', and a third parameter value P3 is 3×GLN/GDN).

FIG. 14 is a view showing a look-up table according to the present invention. A first column designates the number of gate drivers GDN, and a second column designates reference data REF corresponding to the number of gate drivers.

According to the embodiment of the present invention, the reference data REF are determined by parameters, such as the number of gate driver ICs GDN, the number of gate lines, size of a liquid crystal panel, resolution, frame frequency, and so forth.

Figure 15:
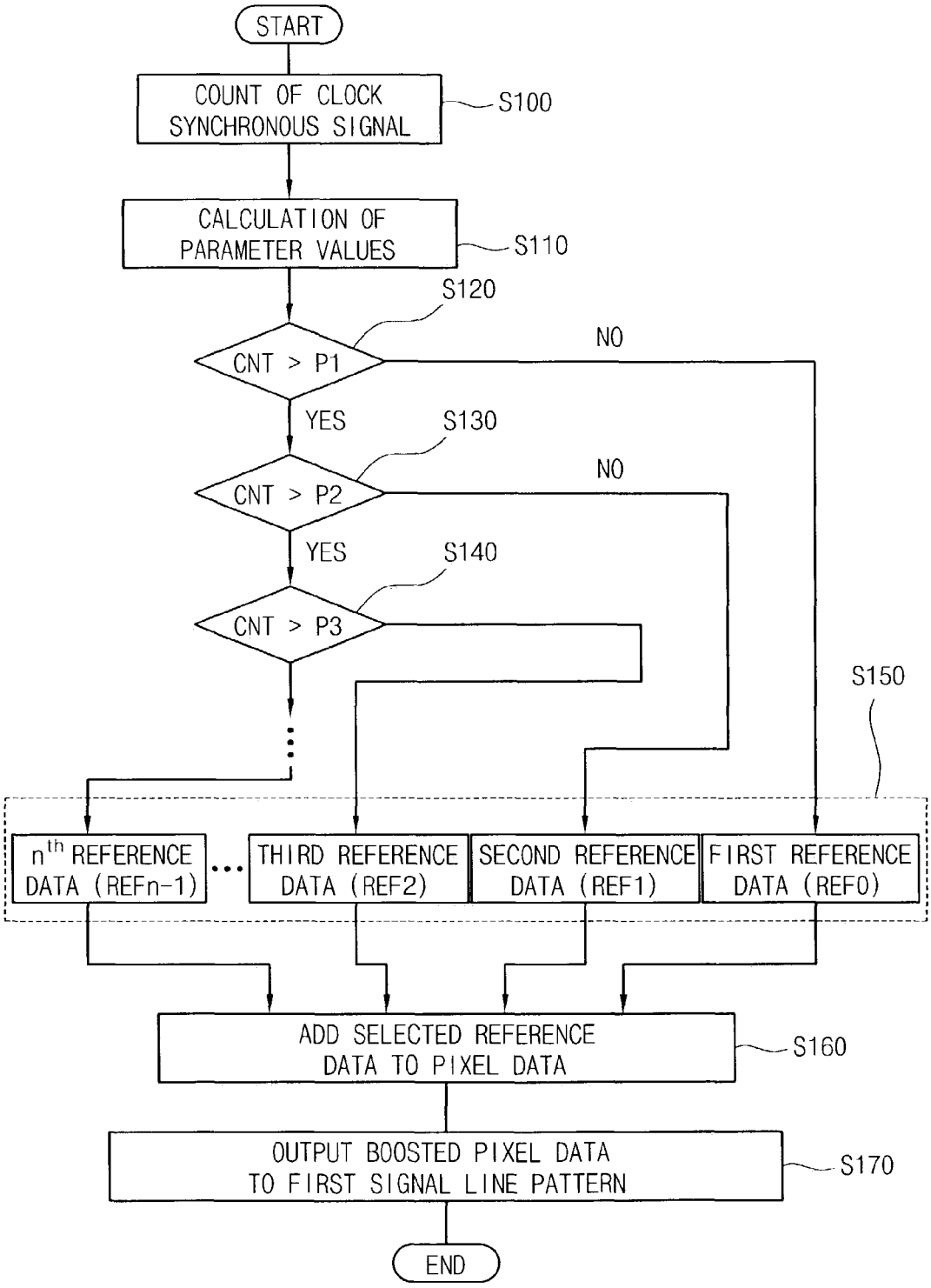
FIG. 15 is a flowchart for explaining a liquid crystal driving method according to the other embodiment of the present invention.

FIG. 15 is a flowchart for explaining a data generation method according to the present invention.

A data generation method according to the present invention will be explained with reference to FIG. 15.

First, the count section 500 generates a count value CNT by counting the transition number of leading edges or tailing edges of a vertical synchronous signal (Step 100).

Subsequently, the control section 600 receives the count value CNT counted by the count section 500, and calculates a plurality of parameter values P1 to Pn on the basis of the number of gate driver ICs and the number of gate lines (Step 110). At this time, the parameters P1 to Pn are calculated by giving different weight values to each division value (GLN/GDN), which is obtained by dividing the number of gate lines GLN by the number of gate drivers GDN.

After the Step 110, the control section 600 compares the count value CNT with the parameter values P1 to Pn and performs judgment processes in sequence (Step 120, Step 130, and Step 140).

As a result of comparison/judgment at Step 120, if the count value CNT is larger than a first parameter value P1, Step 130 is proceeded, while if the count value CNT is not larger than the first parameter value P1, the control section 600 controls the reference data generation section 300 to select and output a first reference data REF0 of the reference data REF0 to REFn−1 pre-stored in the look-up table 200 with reference to the look-up table 200 (Step 150).

As a result of comparison/judgment at Step 130, if the count value CNT is larger than a second parameter value P2, Step 140 is proceeded, while if the count value CNT is not larger than the second parameter value P2, the control section 600 controls the reference data generation section 300 to select and output a second reference data REF1 of the reference data REF0 to REFn−1 pre-stored in the look-up table 200 with reference to the look-up table 200 (Step 150).

As a result of comparison/judgment at Step 140, if the count value CNT is larger than a third parameter value P3, the next step (not shown) for following comparison/judgment is proceeded, while if the count value CNT is not larger than the third parameter value P3, the control section 600 controls the reference data generation section 300 to select and output a third reference data REF2 of the reference data REF0 to REFn−1 pre-stored in the look-up table 200 with reference to the look-up table 200 (Step 150).

Next, the boosting section 400 boosts a signal level of input data by adding the input data to reference data selected by Step 150 (Step 160), and outputs the boosted data to a first signal line pattern (not shown) comprised in the liquid crystal panel 100 (Step 170).

Figure 16:
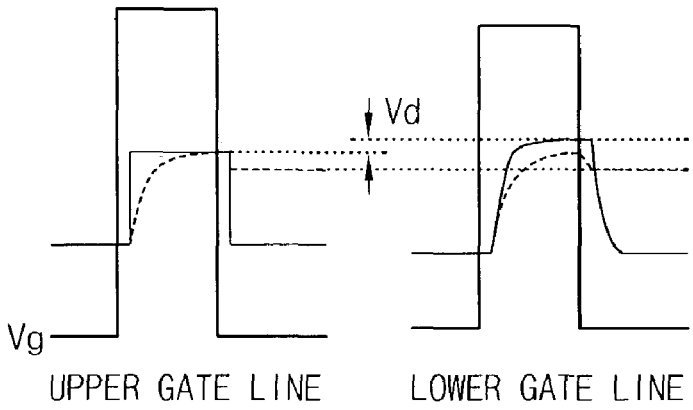
FIG. 16 is a view showing data waveforms according to the other embodiment of the present invention.

FIG. 16 is a view showing data waveforms at an upper end and a lower end of gate lines according to the other embodiment of the present invention. In FIG. 16, a reference character Vd designates an added voltage according to the other embodiment of the present invention.

As shown in FIG. 16, at both upper and lower ends of each gate, pixel electrodes are charged with the same data voltage level.

As described above, a liquid crystal driving device according to the present invention is constructed to subtract a voltage attenuation quantity predetermined corresponding to sequence of each gate driver IC from the gate-off voltage inputted to signal line patterns, and to generate the same gate-off voltage at every gate driver ICs, thereby obtaining improved uniformity of image quality by removing brightness variation of block shape which is caused by gate-off voltage difference among the gate driver ICs. Also, a restriction to the width of signal line patterns for gate-off voltages in a liquid crystal panel is reduced, thereby widening a range in which resistance values can be selected in forming the signal line patterns according to resolution and size of a panel. As a result, it has an effect capable of reducing noise by increasing width of other signal line patterns such as a ground signal line pattern.

In addition, a liquid crystal driving device according to the present invention is constructed to boost signal level of the input data according to the number of gate driver ICs and the number of gate lines, and to generates higher and higher signal level of data in proportion to the number of the gate drivers, so that signal level attenuation of data is compensated, and both upper and lower ends of gate lines can be charged as a desired level of voltage. Therefore, it has another effect of improving screen quality by preventing a gate block phenomenon, variation of uniformity, flicker, and degradation of response speed which are caused by charge voltage difference and charging time delay.

While the invention has been shown and described with reference to certain preferred embodiments thereof, it will be understood by those skilled in the art that various changes in form and details may be made therein without departing from the spirit and scope of the invention as defined by the appended claims. Accordingly, the scope of the invention is not to be limited by the above embodiments but by the claims and the equivalents thereof.

What is claimed is:

1. A liquid crystal display driving device generating gate-on/off signals to drive liquid crystal comprising:

a sequence recognition unit configured to recognize sequence of a pertinent gate driver IC from a plurality of gate driver ICs connected in series by one or more signal line patterns by a pulse width of a vertical start signal inputted in synchronization with a vertical synchronous signal, and to generate a carry signal and location data of the pertinent gate driver IC a gate on-off voltage generation unit for receiving a first gate-off voltage and the location data of the pertinent gate driver IC, and outputting a second gate-off voltage which is generated by subtracting a voltage attenuation quantity corresponding to the location data of the gate driver IC from the first gate-off voltage, wherein the voltage attenuation quantity is calculated by multiplying the voltage of the signal line patterns by the number of gate driver ICs of the series remaining in the current downstream with respect to the location of the gate driver IC without having to require the resistance in the gate driver IC to coincide with the resistance of the signal line patterns.

2. A liquid crystal driving device as claimed in claim 1, wherein the carry signal is provided to the next gate driver IC so as to be used as a vertical start signal.

3. A liquid crystal driving device as claimed in claim 1, wherein at least one state signal is determined according to resolution, size of a liquid crystal panel, and characteristic of a signal line pattern.

4. A liquid crystal driving device comprising:

a sequence recognition means for recognizing sequence of a pertinent gate driver IC by a pulse width of a vertical start signal inputted in synchronization with a vertical synchronous signal, and generating a carry signal and location data of the pertinent gate driver IC;

a gate-off voltage generation means for receiving a first gate-off voltage and the location data of the pertinent gate driver IC, and outputting a second gate-off voltage which is generated by subtracting a voltage attenuation quantity corresponding the location data of the gate driver IC from the first gate-off voltage;

a liquid crystal panel including a plurality of signal line patterns to apply a data signals;

a look-up table for storing a plurality of reference data corresponding to the number of the gate driver ICs;

a reference data generation section for selecting and outputting one of the plurality of reference data;

a boosting section for boosting signal level of input data by adding the selected reference data to the input data, and outputting the boosted input data to the plurality of signal line patterns;

a count section for generating a count value by counting the number of transitional edges of a vertical synchronous signal; and a control section for calculating a plurality of parameter values on the basis of the number of gate driver ICs and the number of gate lines, comparing the count value counted by the count section with the calculated parameter values, and controlling the reference data generation section to select and output one of the plurality of reference data with reference to the look-up table according to a result of the comparison.

5. A liquid crystal driving device as claimed in claim 4, wherein the sequence recognition means comprises:

an m-bit counter for estimating the pulse width of the vertical start signal inputted in synchronization with the vertical synchronous signal, and generating the location data of the pertinent gate driver IC; and a carry signal generation unit for generating the carry signal that a vertical start signal thereof has a pulse width changed on the basis of the location of the pertinent gate driver IC.

6. A liquid crystal driving device as claimed in claim 4, wherein the carry signal is provided to the next gate driver IC so as to be used as a vertical start signal.

7. A liquid crystal driving device as claimed in claim 4, wherein the gate-off voltage generation means receives at least one state signal.

8. A liquid crystal driving device as claimed in claim 7, wherein the at least one state signal is determined according to resolution, size of a liquid crystal panel, and characteristic of a signal line pattern.

9. A liquid crystal driving device as claimed in claim 7, wherein the gate-off voltage generation means subtracts a voltage attenuation quantity corresponding to the location data of the gate driver IC from the first inputted gate-off voltage, and adds a compensation value corresponding to one of the at least one state signal to the subtracted gate-off voltage, thereby generating the second gate-off voltage.

10. A liquid crystal driving device as claimed in claim 4, wherein the plurality of reference data are determined according to the number of the gate driver ICs, the number of gate lines, size and resolution of the liquid crystal panel, and frame frequency.

11. A liquid crystal driving device as claimed in claim 4, wherein the parameter values are determined as values obtained by giving different weight values to each division value obtained by dividing the number of gate lines by the number of gate drivers.

12. A liquid crystal driving device as claimed in claim 1, wherein the gate-off voltage generation unit receives at least one state signal.

13. A liquid crystal driving device as claimed in claim 12, wherein the gate-off voltage generation unit subtracts voltage attenuation quantity corresponding to location data of the gate driver IC from an inputted gate-off voltage, and adds a compensation value corresponding to one of the at least one state signal to the subtracted gate-off voltage, thereby generating the second gate-off voltage.

14. A liquid crystal display driving device as claimed in claim 1, wherein the sequence recognition unit comprises:

a m-bit counter configured to estimate the pulse width of the vertical start signal inputted in synchronization with the vertical synchronous signal, and generating the location data of the pertinent gate driver IC; and a carry signal generation unit configured to generate the carry signal that a vertical start signal thereof has a pulse width changed on the basis of the location of the pertinent gate driver IC.

* * * * *